US008124919B2

(12) United States Patent
Trochlil

(10) Patent No.: US 8,124,919 B2
(45) Date of Patent: Feb. 28, 2012

(54) SINGLE PLY PAPER PRODUCT, METHOD FOR MANUFACTURING, AND ARTICLE

(75) Inventor: Thomas R. Trochlil, Rhinelander, WI (US)

(73) Assignee: Wausau Paper Mills LLC, Mosinee, WI (US)

( * ) Notice: Subject to any disclaimer, the term of this patent is extended or adjusted under 35 U.S.C. 154(b) by 225 days.

(21) Appl. No.: 12/621,954

(22) Filed: Nov. 19, 2009

(65) Prior Publication Data

US 2010/0065237 A1 Mar. 18, 2010

Related U.S. Application Data

(63) Continuation of application No. 11/319,346, filed on Dec. 27, 2005, now Pat. No. 7,642,490, which is a continuation of application No. 10/730,875, filed on Dec. 8, 2003, now Pat. No. 7,067,781.

(51) Int. Cl.
*H05B 6/80* (2006.01)
*D21H 11/00* (2006.01)

(52) U.S. Cl. ..... 219/730; 219/727; 219/725; 219/759; 427/255.6; 427/497; 426/111; 426/107; 426/234; 426/497; 426/409

(58) Field of Classification Search ..... 219/730, 219/727, 725, 759; 427/255.6, 497; 426/111, 426/107, 234, 255.7, 409, 497
See application file for complete search history.

(56) References Cited

U.S. PATENT DOCUMENTS

| | | | | |
|---|---|---|---|---|
| 4,548,826 | A | 10/1985 | Watkins | |
| 4,691,374 | A | 9/1987 | Watkins et al. | |
| 4,878,765 | A | 11/1989 | Watkins et al. | |
| 4,970,358 | A | 11/1990 | Brandberg et al. | |
| 4,973,810 | A | 11/1990 | Brauner | |
| 5,044,777 | A | 9/1991 | Watkins et al. | |
| 5,081,330 | A | 1/1992 | Brandberg et al. | |
| 5,175,031 | A | 12/1992 | Ochocki | |
| 5,285,040 | A | 2/1994 | Brandberg et al. | |
| 5,338,911 | A | 8/1994 | Brandberg et al. | |
| 5,403,998 | A * | 4/1995 | Sheen et al. | 219/730 |
| 5,405,663 | A | 4/1995 | Archibald et al. | |
| 5,460,839 | A | 10/1995 | Archibald | |
| 5,461,216 | A * | 10/1995 | McDonald | 219/727 |
| 5,488,220 | A | 1/1996 | Freerks et al. | |

(Continued)

FOREIGN PATENT DOCUMENTS

WO WO 93/15976 8/1993

*Primary Examiner* — Shawntina Fuqua
(74) *Attorney, Agent, or Firm* — Hamre, Schumann, Mueller & Larson, P.C.

(57) ABSTRACT

In an embodiment, the invention is a single ply paper product comprising a paper substrate having a first surface and a second surface and comprising a web of fibers sufficiently refined to have a Canadian Standard Freeness value of greater than about 100 $cm^3$ according to TAPPI standard test T 227, and having a weight of between about 20 lbs./3,000 $ft.^2$ and about 45 lbs./3,000 $ft.^2$; and a fluorochemical in an amount of at least 800 parts per million. In another embodiment, the invention is a method for processing a single ply paper product comprising the steps of folding a single ply paper product into a container. Processing of the single ply paper product includes at least one of folding, creasing, applying adhesive, applying a susceptor patch, and heat sealing. In another embodiment, the invention is an article comprising a single ply paper product and a charge of oil and popcorn.

14 Claims, 6 Drawing Sheets

U.S. PATENT DOCUMENTS

| | | | | |
|---|---|---|---|---|
| 5,679,278 | A | 10/1997 | Cox | |
| 5,690,853 | A | 11/1997 | Jackson et al. | |
| 5,753,895 | A | 5/1998 | Olson et al. | |
| 5,773,801 | A | 6/1998 | Blamer et al. | |
| 5,994,685 | A | 11/1999 | Jackson et al. | |
| 6,060,096 | A | 5/2000 | Hanson et al. | |
| 6,100,513 | A * | 8/2000 | Jackson et al. | 219/727 |
| 6,396,036 | B1 | 5/2002 | Hanson | |
| 6,790,890 | B2 * | 9/2004 | MacCone et al. | 524/300 |
| 7,067,781 | B2 | 6/2006 | Trochlil | |
| 2003/0080118 | A1 | 5/2003 | Hanson | |
| 2006/0131303 | A1 | 6/2006 | Trochlil | |

* cited by examiner

SINGLE PLY PAPER PRODUCT, METHOD FOR MANUFACTURING, AND ARTICLE

This application is a continuation of application U.S. Ser. No. 11/319,346, filed Dec. 27, 2005, which is a continuation of application U.S. Ser. No. 10/730,875, filed Dec. 8, 2003, which applications are incorporated herein by reference.

FIELD OF THE INVENTION

The invention relates to a single ply paper product, a method for manufacturing a single ply paper product, and an article containing a single ply paper product. In particular, the paper product is constructed to provide a desired level of grease hold out when used in contact with oil containing food product.

BACKGROUND OF THE INVENTION

Paper products have been utilized for containing food. One area in which paper products have been used to contain food includes microwave popcorn bags. In general, the microwave popcorn bag should be capable of containing the popcorn and resisting the passage of oil through the paper product when the bag is being filled, during the shelf life of the popcorn product, and during cooking of the popcorn product in a microwave oven.

Microwave popcorn bags have been made with two plies of paper. Attention has been directed at preparing microwave popcorn bags from a single ply of paper. For example, see U.S. Pat. No. 5,460,839 (Archibald et al.); U.S. Pat. No. 5,461,216 (McDonald et al.); and Publication No. WO93/15976.

SUMMARY OF THE INVENTION

Figure 1:
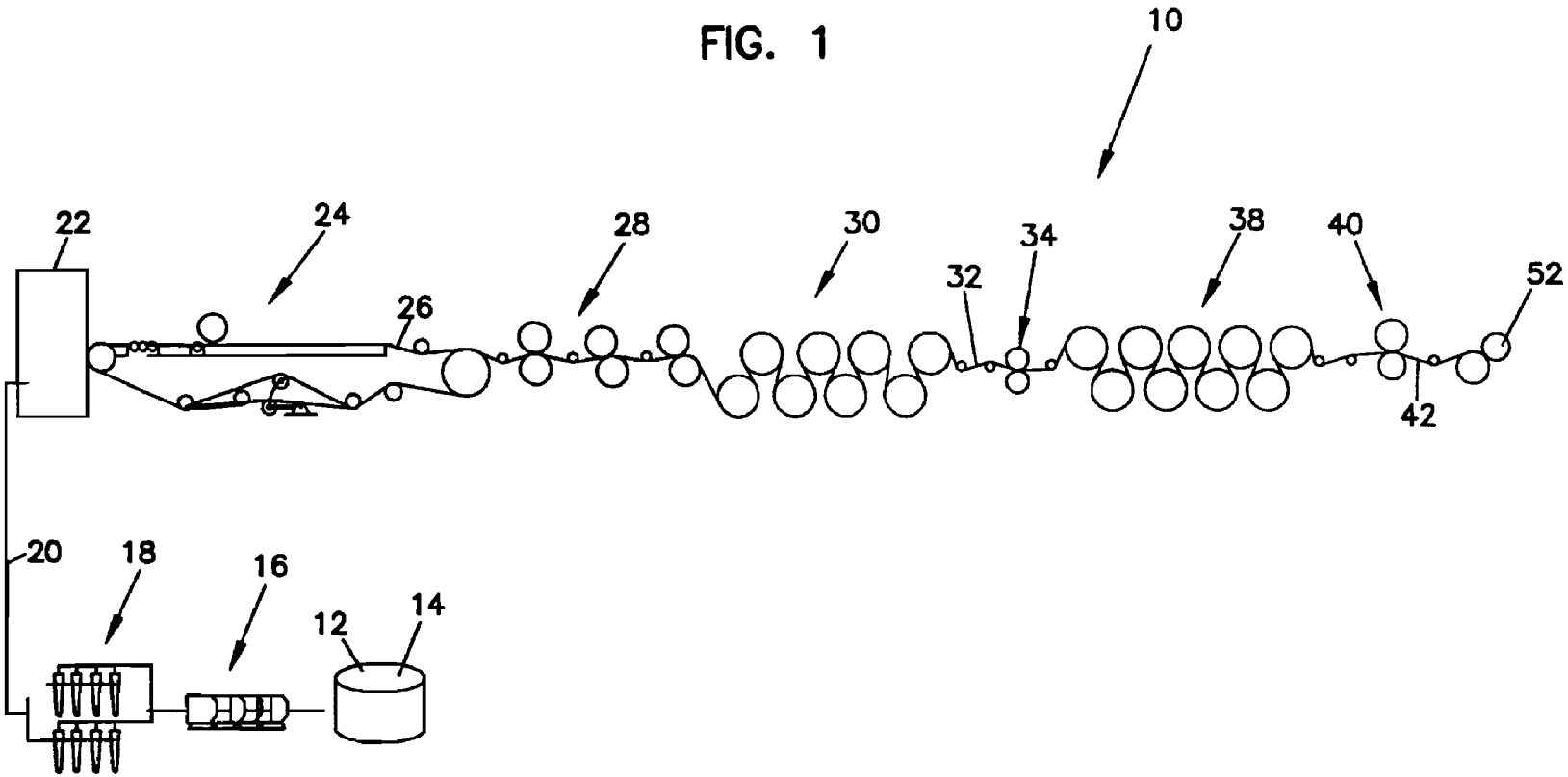
FIG. 1 is a diagrammatic view of an exemplary process for manufacturing a paper substrate according to the invention.

In an embodiment the invention is a single ply paper product comprising a web of fibers having a first surface and a second surface; wherein the web of fibers has a Canadian Standard Freeness of greater than about 100 $cm^3$, a weight of between about 20 lbs./3,000 $ft.^2$ and about 45 lbs./3,000 $ft.^2$, and a fluorochemical application such that the fluorine content in the web of fibers is at least about 800 parts per million (ppm).

In another embodiment, the invention is a method for forming a container from a single ply paper product comprising the steps of processing a single ply paper product; wherein the single ply paper product comprises a paper substrate having a first surface and a second surface and comprising a web of fibers sufficiently refined to have a Canadian Standard Freeness value of greater than about 100 $cm^3$ according to TAPPI standard test T 227, and having a weight of between about 20 lbs./3,000 $ft.^2$ and about 45 lbs./3,000 $ft.^2$; and a fluorochemical in an amount of at least 800 ppm. In an embodiment, the processing of the single ply paper product includes at least one of folding, creasing, applying adhesive, applying a susceptor patch, and heat sealing.

In another embodiment, the invention is an article comprising a single ply paper product having a web of fibers with a first surface and a second surface; wherein the web of fibers has a Canadian Standard Freeness of greater than about 100 $cm^3$, a weight of between about 20 lbs./3,000 $ft.^2$ and about 45 lbs./3,000 $ft.^2$, and a fluorochemical application such that the fluorine content in the web of fibers is at least about 800 parts per million (ppm). The article also comprises a charge of oil and popcorn.

DETAILED DESCRIPTION OF THE PREFERRED EMBODIMENT

A single ply paper product is provided by the invention. The phrase "single ply" refers to the existence of a continuous single web of fibers that is not laminated to another continuous web of fibers. It should be understood that the phrase "single ply" does not exclude the presence of other components and/or layers on the surface of the web of fibers. By way of example, the phrase "single ply" does not exclude a susceptor patch being adhered to the web of fibers nor does it exclude films or adhesives on the web of fibers. The single ply paper product can be referred to more simply as the paper product.

The single ply paper product of the invention can serve to provide grease hold-out or function as a barrier to grease and oil. "Grease hold-out" refers to the ability of the paper to resist penetration and/or leakage of grease and oil. This property can be measured by determining how long it takes a hydrocarbon solvent, such as turpentine, to leak through the paper product. This property can also be measured through a crease test that measures the amount of a dyed oil which leaks through the paper product over a period of time.

In order to provide enhanced grease holdout, or enhanced resistance to oil and grease penetration, the web of fibers can be treated with a fluorochemical. In some embodiments, both sides of the paper product are treated with fluorochemicals that penetrate throughout the interior of the single ply and cause the web of fibers to have enhanced grease holdout. Where fluorochemicals have penetrated throughout the interior of the single ply, the single ply provides grease holdout even when the ply is creased forming fractures in the paper that expose the interior of the ply. Penetration of the fluorochemical can be enhanced by using a paper that is less than highly refined. It is believed that refining of fibers results in paper with fewer voids and holes. With fewer voids and holes, paper made with such refined fibers has a tendency to resist the penetration of fluorochemicals.

Resistance to oil and grease penetration can also be enhanced by applying a film layer the web of fibers. By way of example, a film layer may be applied to discrete areas of the paper that may be folded or creased when a bag is formed. While not intending to be bound by theory, it is believed that this film layer acts to prevent the paper substrate from fracturing and prevents oil from leaking through. Moreover, it is believed that the film layer can act as a barrier to oil itself. In an embodiment, a film layer is applied to discrete areas of the web of fibers that will have creases. The manufacture and the components of the invention will now be described in greater detail.

Manufacture of the Single Ply Paper Product

Referring to FIG. 1, a process for making a paper substrate according to the invention is shown at reference numeral 10. It should be understood that schematic diagram 10 is an exemplary schematic diagram and includes many of the operations carried out in commercial paper making facilities. The equipment used in a particular operation may vary from facility to facility, but it is expected that the general operations will be present.

The starting material 12 generally includes wood pulp 14. The wood pulp can include a blend of hard wood and soft wood fibers. The wood pulp can be provided as cellulose fiber from chemical pulped wood, and can include a blend from coniferous and deciduous trees. By way of example, the fibers can be from Northern hardwood, Northern softwood, Southern hardwood, or Southern softwood. Hardwood fibers tend to be more brittle but are generally more cost effective for use because the yield for pulp from hardwood is higher than the yield for pulp from softwood. Softwood fibers have better characteristics but are more expensive. Blends of hardwood and softwood fibers are frequently used. The fibers can also be bleached or unbleached. The wood pulp 14 can be processed through a refining operation 16 and through a cleaning operation 18. The cleansed pulp 20 is then applied through a head box 22 onto a fourdrinier machine 24 to provide a paper base sheet 26. Certain additives can be added prior to the head box 22 and this is referred to as "wet end chemistry."

Fluorochemicals can be added to enhance grease holdout. While fluorochemicals can be added as a part of wet end chemistry, they can also be applied later on, such as at the size press. Fluorochemicals added as a part of wet end chemistry permeate throughout the paper base sheet 26 created. However, application at this stage results in a loss of at least 20% of the fluorochemicals because water is later drawn out of the cleansed pulp 20.

Wet end additives can also be provided for sizing, strength, opacity, water resistance, and/or oil resistance. Exemplary water resistance additives include rosin and allylketene dimer (AKD). Exemplary strength additives include urea formaldehyde and polyamide. Exemplary opacifying additives include kaolin clays, titanium dioxide, and calcium carbonate. Other components, such as defoaming agents, pitch dispersants, dyes, etc. may also be added prior to the head box 22.

The paper base sheet 26 can be considered continuous in the machine direction. The paper base sheet 26 can be processed through a wet press section 28 to remove water, and then through a drier section 30 to further reduce the water content and provide a web of fibers 32. The web of fibers 32 can be dried to a moisture level of between about 0.5 wt. % to about 5 wt. %.

The web of fibers 32 is processed through a size press 34 for the application of a surface treatment to provide a paper substrate. Certain additives can be added to the size press solution and this is referred to as "size press chemistry." Size press additives can be provided for sizing, strength, to close up the surface of the sheet (film formers), to fill in the surface of the sheet, for water resistance, and/or oil resistance. Exemplary water resistance additives include alkyl ketene dimmer (AKD), styrene maleic anhydride (SMA), and waxes. Exemplary oil resistance additives include fluorochemicals. Fluorochemicals can be applied to both surfaces of the web of fibers. Exemplary fillers include kaolin clays, titanium dioxide, and calcium carbonate. Plasticizers may also be added at the size press 34. Plasticizers include humectants and can function to keep paper soft and make it less likely that the paper will fracture. Suitable plasticizers include urea, nitrates, glycerine, and saccharides (such as NEOSORB®, available from Roquette Corp., Gurnee, Ill.).

There are also other means of applying components besides applying them at the size press 34. Other application technologies including a metering film size press, roll coaters, and blade coaters may also be used to apply components to the web of fibers 32.

The treated paper substrate is then dried in a second drier section 38 and calendered in a machine calender 40 to provide a calendered paper substrate 42. The calendered paper substrate 42 can then be sent to a winder and put on a roll 52. When put on a roll 52, the paper substrate 42 can be referred to as roll stock.

At this point, the roll stock can be sold and/or shipped to a converter for processing or can simply be fed into a further line for processing. Processing of the roll stock is the conversion of the paper substrate into an article such as a container or bag. Processing may include folding, creasing, applying adhesive, applying a susceptor patch, heat sealing, and other steps for turning the paper substrate into the desired article.

Figure 2:
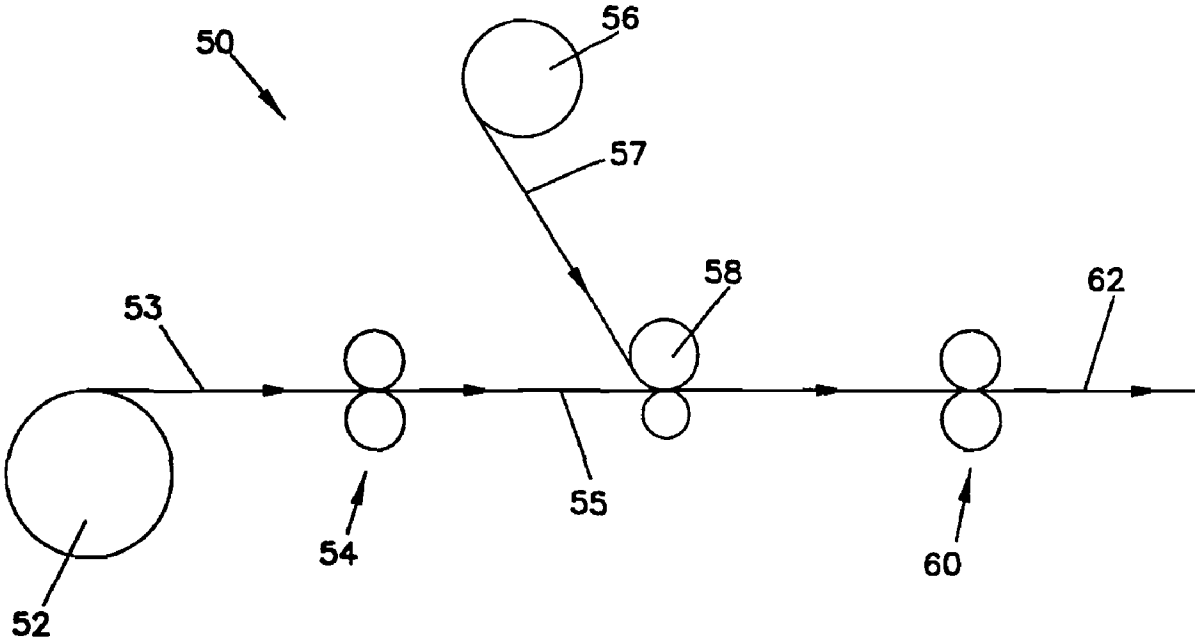
FIG. 2 is a diagrammatic view of an exemplary single ply roll stock conversion process according to the invention.

Referring now to FIG. 2, a diagrammatic view of an exemplary single ply roll stock conversion process according to the invention is shown. The conversion process is started by unwinding paper substrate 53 off of a roll 52. In embodiments where a susceptor patch is used, an adhesive 78 (shown in FIG. 4) is applied 54 to the paper substrate 53. Susceptor patch material 57, is unwound off of a susceptor patch roll 56. At this point, both the susceptor patch material 57 and the paper substrate with adhesive 55 are fed into a nipping roller 58. The nipping roller cuts segments of the susceptor patch material and applies them to the paper substrate with adhesive 55. After this, heat sealing adhesive is applied 60 to the single ply paper product 62 where needed for bag formation. Alternatively, a film is applied 60 to discrete areas of the single ply paper product 62, in which case the heat sealing adhesive can be applied as a part of later processing such as printing and forming the bag (not shown). The single ply paper product 62 continues on to either be put on another roll or to be folded into a bag (not shown).

Figure 3:
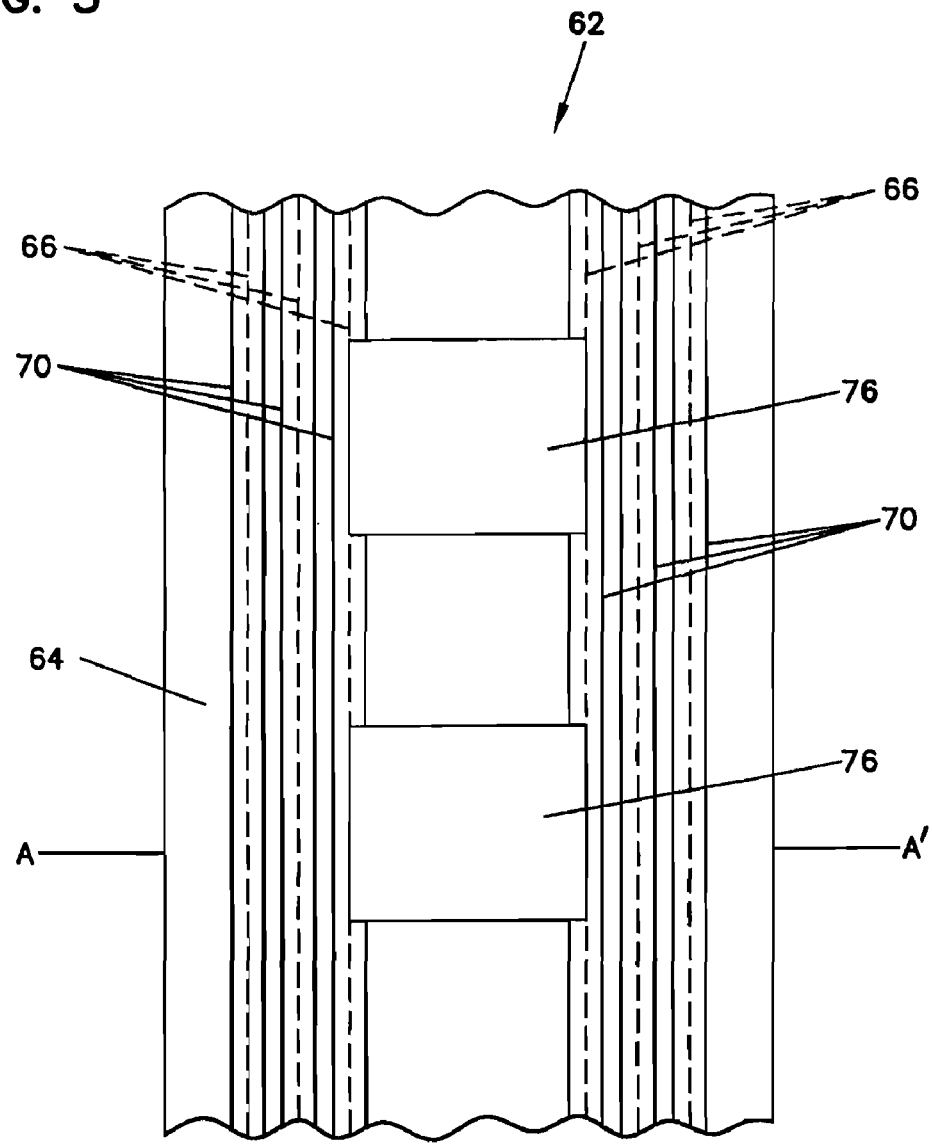
FIG. 3 is a top view of an embodiment of the paper product of the invention.

FIG. 3 shows a top view of an embodiment of a single ply paper product 62 of the invention. In FIG. 3, susceptor patches 76 are shown as applied to a continuous sheet of single ply paper product 62. Gusset creases 66 are on both edges of the single ply paper product 62 and mark areas where the paper will later be creased when a bag is formed. In the embodiment shown in FIG. 3, films 70 have been applied in discrete areas over the gusset creases 66 to aid in grease hold out. In other embodiments such films are not used.

Figure 4:
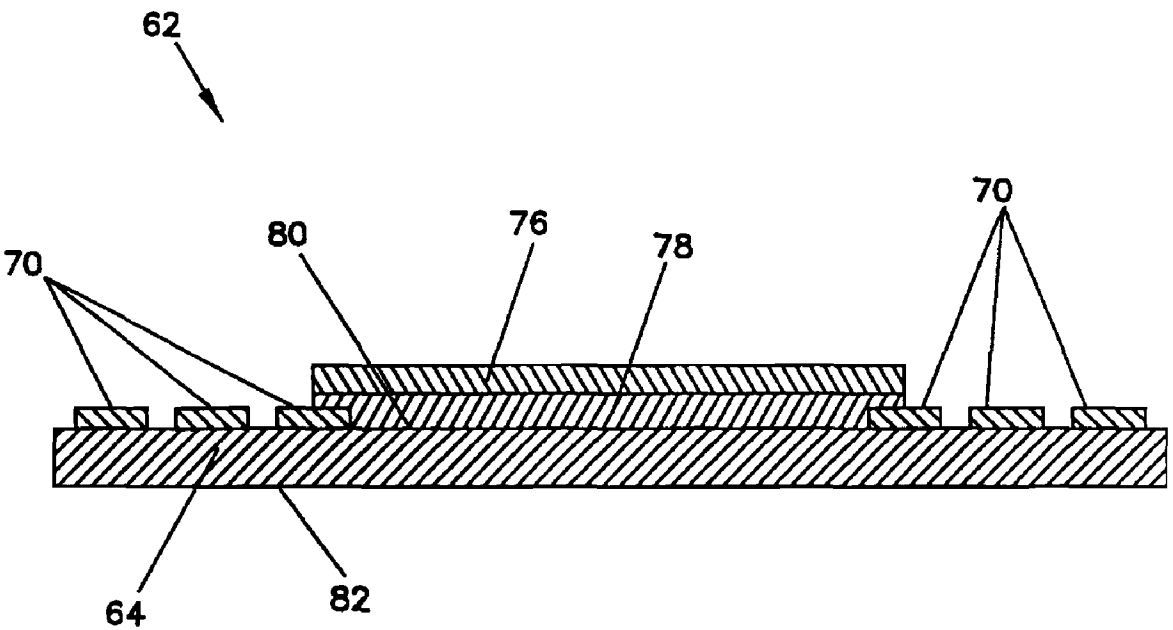
FIG. 4 is a non-scale cross-sectional view of the paper product of FIG. 3 taken along lines A-A'.
Figure 5:
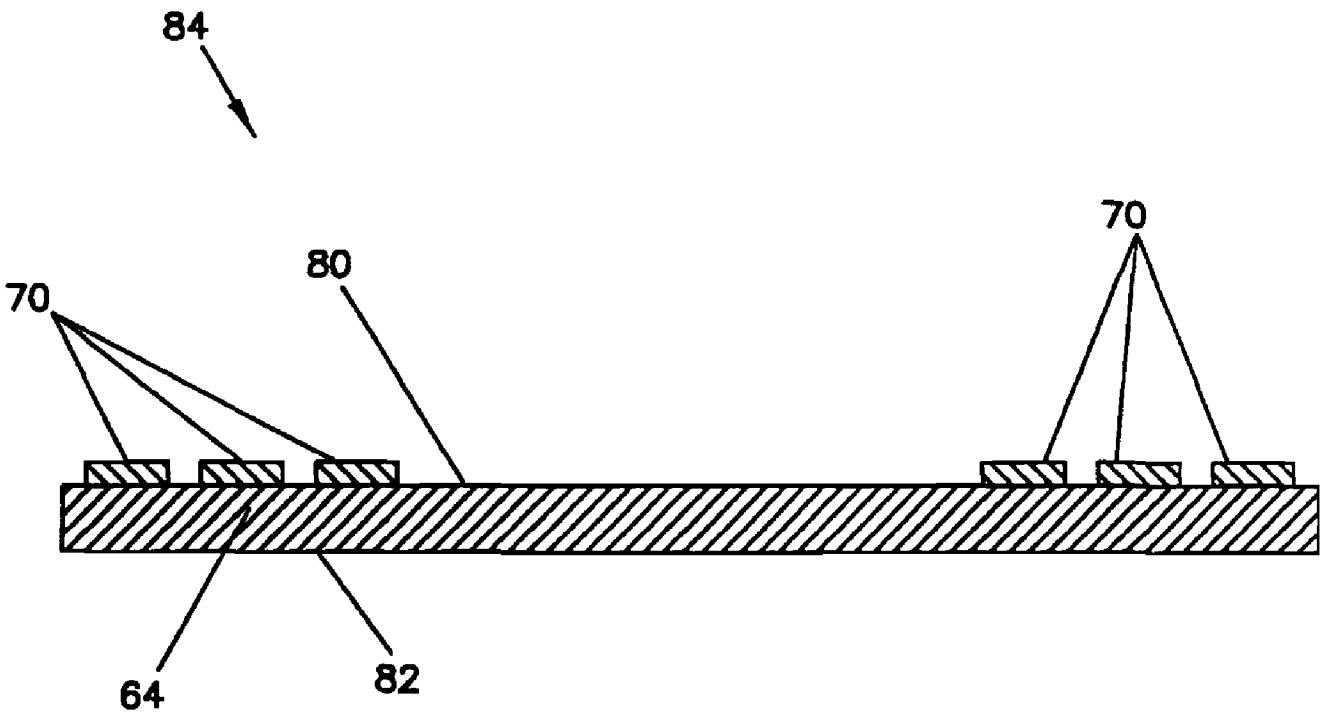
FIG. 5 is a non-scale cross-sectional view of another embodiment of the invention.

FIG. 4 is a cross-sectional view of a single ply paper product 62 taken along lines A-A' of FIG. 3. The web of fibers 64 has both a first surface 80 and a second surface 82. In the embodiment shown, films 70 have been applied to the first surface 80 of the web of fibers 64 to aid in grease hold out. An adhesive 78 has been applied to the first surface 80 of the web of fibers 64 in order to bind the susceptor patch 76 in place. Other embodiments do not have a susceptor patch, such as the embodiment of a single ply paper product 84 shown in FIG. 5.

The handling of a single ply product can be more difficult, especially where susceptors are adhered to a single ply of paper. A susceptor can add an additional thickness in the area where the susceptor is adhered. For example, a susceptor may add an additional 0.0005 inches in the area of the paper where the susceptor is adhered. This leads can lead to difficulty winding the paper, with the susceptors, onto a roll when standard methods of paper handling are employed. In accordance with the present invention, there are a couple of methods of handling such difficulties. First, the wind-up process can be changed such that the tension on the paper is applied to the center of the continuous sheet instead of at the edges of the sheet. Second, the roll can be oscillated as the paper is being wound onto it, such that the susceptor patch is not located in the same position on the width of the roll with every additional winding.

Web of Fibers

Refining is the treatment of pulp fibers to develop their papermaking properties. Refining increases the strength of fiber to fiber bonds by increasing the surface area of the fibers and making the fibers more pliable to conform around each other, which increases the bonding surface area and leads to a denser sheet, with fewer voids. Most strength properties of paper increase with pulp refining, since they rely on fiber to fiber bonding. The tear strength, which depends highly on the strength of the individual fibers, actually decreases with refining. Refining of pulp increases the fibers flexibility and leads to denser paper. This means bulk, opacity, and porosity decrease (porosity values increase) with refining. Fibrillation is a result of refining paper fibers. Fibrillation is the production of rough surfaces on fibers by mechanical and/or chemical action; refiners break the outer layer of fibers, i.e., the primary cell wall, causing the fibrils from the secondary cell wall to protrude from the fiber surfaces.

The extent to which a paper product is made with refined fibers can be measured through several means. One type of testing for refined fibers is referred to as freeness testing. In this mode of testing, the speed with which water drains through a sample piece of paper is measured. Because paper made with highly refined fibers has fewer voids and small holes, it takes water longer to drain through a sheet of paper made with highly refined fibers. A standard for this mode of testing is the Canadian Standard Freeness (CSF) test. The CSF test was developed for use with groundwood pulps and was not intended for use with chemical pulps; nevertheless, it is the standard test for monitoring refining in North American mills. TAPPI (Technical Association of the Pulp and Paper Industry) standard test T 227 corresponds to the CSF test. Another common test of the refined nature of paper is the Shopper Riegler test, which is similar in concept to the CSF test.

Highly refined paper has a tendency to resist to fluorochemical penetration, preventing fluorochemicals from permeating throughout the thickness of the single ply. It is believed that this is because paper made with highly refined fibers has fewer voids and holes. Modifying the refined nature of the fibers may be desired to generate fibers with a level of refining that does not resist fluorochemical penetration as much as more highly refined fibers. In an embodiment, fibers are used that have a Canadian Standard Freeness of greater than about 100 $cm^3$. Less refined paper has more voids and holes and this may lead to decreased resistance to oil and grease penetration. In an embodiment, fibers are used that have a freeness of less than about 400 $cm^3$. In some embodiments of the invention, the web of fibers is made with fibers having a Canadian Standard Freeness of about 100 $cm^3$ to about 400 $cm^3$. The web of fibers may also have a Canadian Standard Freeness of about 150 $cm^3$ to about 350 $cm^3$ or even from about 200 $cm^3$ to about 300 $cm^3$. In a particular embodiment, the web of fibers has a Canadian Standard Freeness of about 250 $cm^3$ according to the TAPPI Canadian Standard Freeness test.

The paper substrate refers to the web of fibers and additives from both wet end chemistry and size press chemistry. Using paper that is heavier than necessary may be economically inefficient. In an embodiment, the paper substrate is less than about 45 pounds per 3000 $ft^2$ of paper. Generally, paper machines don't handle paper that is less than about 18 pounds per 3000 $ft^2$ of paper. In an embodiment, the paper substrate is greater than about 18 pounds per 3000 $ft^2$ of paper. The paper substrate of the invention may also be in the range of 20 to 45 pounds per 3000 $ft^2$ of paper. In a particular embodiment, paper of about 38 pounds per 3000 $ft^2$ is used.

The wood pulp can include a blend of hard wood and soft wood fibers. The wood pulp can be provided as cellulose fiber from chemical pulped wood, and can include a blend from coniferous and deciduous trees. By way of example, the fibers can be from Northern hardwood, Northern softwood, Southern hardwood, or Southern softwood. Hardwood fibers tend to be more brittle but are generally more cost effective for use because the yield for pulp from hardwood is higher than the yield for pulp from softwood. Softwood fibers have better characteristics but are more expensive. Blends of hardwood and softwood fibers are frequently used.

In some embodiments, the single ply paper product should not be too transparent, as the contents of the popcorn bag would be visible before popping. In order to prevent the paper from being too transparent, various components can be added to make the paper more opaque. As one example, amounts of titanium dioxide can be added to the paper to make the paper more opaque. Other examples of potential additives include kaolin clays and calcium carbonate.

In embodiments of the invention that will have graphic printing the web of fibers may have its surface treated in such a way so as to enhance the print characteristics. This may include the use of a film forming component, such as starch, to smooth the paper surface for uniform ink acceptance. The paper could also be calendered to smooth the paper surface, improving the final print.

Fluorochemicals

When fluorochemicals are applied to the surface of a web of fibers, they can render the surface oleophobic such that the surface repels oil and resists oil penetration. Accordingly, after the surface of the web has been treated fluorochemically, oil generally tends to bead up on the surface. When paper is folded and creased, its surface tends to fracture and expose the interior of the web of fibers. Where only the surface of the web of fibers has been treated fluorochemically, exposure of the untreated interior of the web of fibers can lead to a failure in oil resistance. In an embodiment of the invention, the web of fibers is fluorochemically treated such that fluorochemicals penetrate into and/or throughout the interior of the web of fibers so that a failure in oil resistance is prevented when the surface of the single ply paper product fractures due to folding and creasing.

There are many methods of ensuring fluorochemical penetration that are contemplated by the present invention. As discussed above, highly refined paper is resistant to fluorochemical penetration, preventing fluorochemicals from permeating throughout the thickness of the single ply. In an embodiment, fibers are used that have a Canadian Standard Freeness of greater than about 100 $cm^3$. Less refined paper has more voids and holes and this may lead to decreased resistance to oil and grease penetration. In an embodiment, fibers are used that have a freeness of less than about 400 $cm^3$. In some embodiments of the invention, the web of fibers is made with fibers having a Canadian Standard Freeness of about 100 $cm^3$ to about 400 $cm^3$. The web of fibers may also have a Canadian Standard Freeness of about 150 $cm^3$ to about 350 $cm^3$ or even from about 200 $cm^3$ to about 300 $cm^3$. In a particular embodiment, the web of fibers has a Canadian Standard Freeness of about 250 $cm^3$ according to the TAPPI Canadian Standard Freeness test.

In an embodiment, the fluorochemical treatment is conducted as a part of "wet-end chemistry," and thus added prior to the head box 22 (as shown in FIG. 1). Applying the fluorochemical at this point in the paper making process, where the pulp has not yet been formed into a continuous sheet, can result in fluorochemical permeation of the entire web of fibers thickness. Application of the fluorochemical at this point can be inefficient as 20% or more of the fluorochemicals applied will be lost as the pulp continues on through the head box 22 onto a fourdrinier machine 24 to provide a paper base sheet 26.

In an embodiment, the fluorochemical treatment is conducted as a part of "size-press chemistry," and is applied as the web of fibers 32 is processed through a size press 34 (referring to FIG. 1). The fluorochemicals can be applied to either one or both surfaces of the continuous sheet. In a particular embodiment, the fluorochemicals are applied to both surfaces to enhance penetration of the fluorochemicals into the interior of the web of fibers 32. Further, the amount of fluorochemicals applied at the size press 34 can be varied. Applying a greater amount of fluorochemicals can result in improved permeation of the web of fibers 32.

The amount of fluorochemicals applied can be measured by determining the amount of fluorine in the web of fibers. A fluorine analyzer, such as the Antek Model 9000F, available from Antek Instruments LP, 300 Bammel Westfield Road, Houston, Tex. 77090, can be used on a sample piece of the web of fibers. Then the flow rate of fluorochemicals is adjusted until the amount of fluorine is at a desired level. In an embodiment of the invention the level of fluorine in the web of fibers is greater than about 800 parts per million (ppm). Using more fluorochemicals than necessary for adequate performance may be uneconomical, therefore in an embodiment, the level of fluorine in the web of fibers is less than about 2000 ppm. The level of fluorine may also be between about 800 ppm and 2000 ppm. In another embodiment the level of fluorine in the web of fibers is between about 1000 ppm and 1400 ppm. In particular, the level of fluorine in the web of fibers may also be about 1200 ppm.

Fluorochemicals for use with the invention should be safe for contact with food and should be approved for use with high temperature applications. Exemplary fluorochemicals that can be used include those known in the industry that can be referred to as paper fluorochemicals, paper fluoro-protectants, or perfluorinated surfactants. One example of a suitable compound for use with the present invention is LODYNE® P-208E, which is available from Ciba Specialty Chemicals. Other suitable compounds include ZONYL® 9464 available from Dupont, Wilmington, Del., and FLUOROLINK® available from Ausimont USA, Thorofare, N.J.

Grease Holdout Tests

One of skill in the art will appreciate that the ability of a paper product to provide grease holdout can be tested in many ways. For example, a standard procedure for this test is described by the TAPPI turpentine test for voids in glassine and greaseproof papers (TAPPI test T 454 om-94). The results of this test are measured in terms of how many minutes it takes before any turpentine starts to show through the paper product. In an embodiment of the invention, the single ply paper product resists turpentine showing through the paper product for greater than 180 minutes.

Grease hold out can also be measured through what is known as crease testing, or a RP-2 fat test. The procedure for crease testing is as follows: 1.) age a sample in a humidity room (50% RH/73° F.) for two hours; 2.) cut the sample into 4"×4" squares; 3.) lay the sample on a glass plate and fold in half then lightly crease the fold with a finger using light pressure, then roll a rubber roller over the crease, then unfold the sample and roll the rubber roller back over the crease, then fold a new crease perpendicular to the first but with the reverse side inward, lightly crease with a finger and roll the rubber roller over the crease, then unfold and roll the rubber roller back over the crease; 4.) place a grid printed sheet on top of a back sheet and then place on a backup board; 5.) place a creased sample on the grid; 6.) place a metal ring on each sample; 7.) place 5 grams of sand onto each sample; 8.) add 1.3 cc of 60° C. RP-2 oil (RP-2 oil is available from Ralston Purina Co.), to each sand pile; 9.) place samples in a 60° C. oven for 24 hours; 9.) remove samples from oven and examine grid sheets; 10.) grade the amount of stain on the grid printed sheet where each grid square is equal to 1%. The grading standard is as follows: each grid square that is 7.00% or more stained counts as 1% of the total; each grid square that is from 1.00% to 7.00% stained counts as 0.5% of the total; each grid square that is 0.25% to 1.00% stained counts as 0.25% of the total; each grid square that has a few specks to 0.25% stained counts as 0.1% of the total. After visually assessing each grid square a total percentage for the sample sheet can be calculated. When the total amount of stain is in the range of 1.0% to 7.0%, the number is rounded up to the nearest 0.5%. The average of four creased samples is determined to be the percentage for the sample. 0.0% would represent absolutely no oil leaking through. 100.00% would represent a complete failure with the entire grid being covered. An amount of oil leaking through greater than 2.00% can be considered undesirable. In an embodiment, the single ply paper product has a leak through of less than about 2.00%. The single ply paper product may also have a leak through of less than about 0.25%.

The ability of a paper product to function as a grease barrier specifically for popcorn bags can also be tested in various ways. One test is to fill a bag made from the paper product with oil and then put it in an oven maintaining a temperature of 100° F. The results of this test are measured by how long it takes before oil passes through the paper bag. A second test is simply to pop corn and see if any oil leaks through.

Film Layer

Where single ply paper is used, there can be issues with oil penetration in areas of the bag that are folded, such as corner creases. In corners, the surface of the paper can split. Thus, even where the surface of the paper substrate has been rendered oleophobic through fluorochemical treatment, the oil can penetrate through the cracks and ultimately leak through the single paper ply. In an embodiment, a film can be applied in discrete areas of the single ply paper product that are likely to develop cracks, such as in areas that will be folded and creased. Thus, because the film is applied to discrete areas, it is not applied as a continuous film over the entire surface of the web of fibers. In another embodiment, a film and a layer of polyvinyl acetate (PVA) is applied in discrete areas of the single ply paper product that will be folded and creased.

When used, a film forming solution can be provided at the size press to the exterior of a given layer of paper to create a film. A film forming solution may also be provided during later processing, such as depicted at 60 of FIG. 2. The film should be appropriate for contact with food, adhere to the paper sufficiently under the conditions of use, and adhere to the laminating adhesive under conditions of use. Many types of film forming solutions are contemplated by the present invention. Suitable film forming solutions can include oxidized starches (corn, wheat, potato, tapioca, etc.), ethylated starches, cationic starches, unmodified starches, starch based adhesives, proteins, synthetic resins, polyvinyl acrylates, polyvinyl acetate, polyvinyl alcohol, polyvinylalcohol based adhesives, vinyl acetate acrylic, styrene acrylates, vinyl acetate, ethylene vinyl acetate, styrene maleic anhydride as well as viscosity modifiers such as sodium alginate, sodium carboxymethyl cellulose, hydroxylethyl cellulose, poly sodium acrylate, guar gum, gum arabic, xanthan gum, or combinations thereof. By way of further example, ethylated starch is available from Penford Products Co., 1001 First Street S.W., Cedar Rapids, Iowa 52404.

Though the film can be made from components that can act as adhesives in other contexts, when used to create a film, these components are not functioning as adhesives because they are not being used primarily to adhere one component to another.

In an embodiment of the invention, the film forming solution is a combination of starch and alginate. The combination of starch and alginate is known to be compatible with food and can also be printed on. Alginate is a natural polysaccharide produced from seaweed, which is soluble in cold or hot water. Starch and alginate are both commercially available. One type of alginate used is sodium alginate sold as SNP S-500-C and is available from Synthetic Natural Polymers (SNP), PO Box 11575, Durham, N.C. 27703.

Susceptor Patch

In some embodiments, the single-ply paper product may also include a susceptor patch. A susceptor patch is sometimes used because it is believed to aid in functioning of a bag for microwave heating by interacting with the microwave radiation and acting as a focal point for heat generation. The susceptor patch may be constructed from a 48-gauge or 0.5 mil metallized polyester film, vacuum deposited metal, carbon or metallic based coatings, laminates, inks or print, other microwave interactive material(s), or any combination thereof. Exemplary susceptor patches are disclosed in U.S. Pat. No. 6,586,715 (Watkins), U.S. Pat. No. 6,137,098 (Moseley et al.), and U.S. Pat. No. 5,614,259 (Yang et al.), the disclosures of which are herein incorporated by reference.

The application of the susceptor patch is dependent on the requirements of the converter or the converting process. The susceptor patch could be laminated with a non-greaseproof paper prior to application to the paper substrate. Thus, in some embodiments, the paper covered susceptor patch would not be exposed directly to the popcorn oil or popcorn. The susceptor could also be a lower temperature patch (a "safety" susceptor) allowing for direct contact between the susceptor patch and the popcorn oil or popcorn. One example of a suitable adhesive for laminating the susceptor patch to the single ply paper is NATIONAL 33-9138 sold by National Starch and Chemical Co., 3405 Commerce Court, Appleton, Wis. 54911. The susceptor patch could also be placed on the outside surface of the paper substrate, either covered with a laminated paper or exposed as a susceptor film.

Applications of the Single Ply Paper Product

One of skill in the art will appreciate that the invention has many applications. For example, it may be used in the formation of bags or containers to hold various food products including: popcorn, french fries, pizza, frozen dinners, and many others. The invention may also be used in non-food applications where grease hold-out is a requirement, such as tubes for holding lubricating oils or greases. Similarly, the invention can be used to form containers for holding metal parts that are shipped with grease pre-applied.

Paper products used in food applications have certain requirements. The paper, when used for making a bag, should have the necessary strength requirements to allow for the bag converting process, the filling process, and finally end-use by the customer. In the context of paper products used for popcorn bags, the paper product should be opaque enough for print requirements and to hide the popcorn oil and popcorn. The paper should also have the necessary stiffness to allow for filling on the popcorn equipment lines. Finally, the paper product should be oil resistant so as to prevent oil from leaking through the paper both during storage of the unpopped product and during popping of the corn.

The oil used with microwave popcorn is typically filled into the bag as a liquid, then solidifies as it cools. As the food is heated up for popping, the oil once again becomes a liquid. The temperature of the oil can be higher than 450° F. In addition to preventing oil from leaking through the paper, it is also important that materials from the paper product do not migrate into the oil under the conditions of use. In an embodiment of the invention, a paper product is provided that can used to make a single ply popcorn bag that meets the desired standards.

Figure 6:
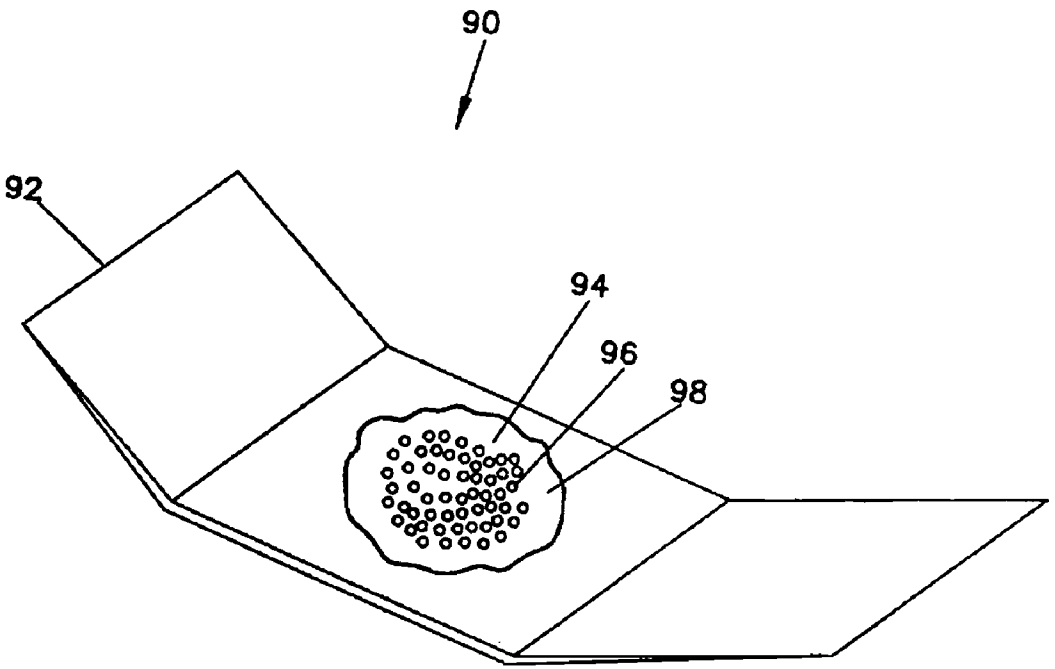
FIG. 6 is a perspective view of an embodiment of the invention in the form of a bag with a popcorn and oil charge.

In embodiments of the invention used as popcorn bags, the invention may be formed into a bag that may contain a charge of popcorn and oil. The oil may be either a liquid or a solid. The charge may also comprise other components such as flavorings (butter, salt, etc.) and preservatives. Referring now to FIG. 6, a trifold popcorn bag in an unpopped state 90 is shown made from a single ply paper product 92 of the invention. The popcorn bag 90 contains a charge 94 comprising popcorn 96 and oil 98.

The above specification provides a complete description of the manufacture and use of the composition of the invention. Since many embodiments of the invention can be made without departing from the spirit and scope of the invention, the invention resides in the claims hereinafter appended.

I claim:

1. A paper product, comprising:

(a) a paper substrate comprising a web of fibers sufficiently refined to have a Canadian standard freeness value of greater than about 100 $cm^3$ according to TAPPI standard test T 227, and having a weight of about 20 lbs./3000 $ft.^2$ to about 45 lbs./3000 $ft.^2$;

(b) a sufficient amount of fluorochemical to provide grease hold out of less than 2.00% according to a crease testing; and (c) a film covering at least a portion of the web of fibers, wherein the film includes a viscosity modifier in an amount sufficient to render the film non-adhesive and enhance grease hold out in the portion of the web of fibers covered by the film.

2. A paper product according to claim 1, wherein the web of fibers comprises cellulose fiber from chemical pulped wood comprising at least one of coniferous and deciduous trees.

3. A paper product according to claim 1, wherein the web of fibers comprises cellulose fiber from chemical pulped wood comprising at least one of hardwood and softwood.

4. A paper product according to claim 1, wherein the web of fibers comprises bleached cellulose fiber.

5. A paper product according to claim 1, wherein the web of fibers has a Canadian Standard Freeness of about 100 $cm^3$ to about 400 $cm^3$.

6. A paper product according to claim 1, wherein the web of fibers has a weight of 20 lbs./3,000 $ft.^2$ to 45 lbs./3,000 $ft.^2$.

7. A paper product according to claim 1, wherein the fluorochemical comprises a perfluorinated surfactant and the fluorochemical is applied as a part of wet-end chemistry.

8. A paper product according to claim 1, wherein the paper product resists turpentine according to TAPPI test T 454 om-94 for longer than 180 minutes.

9. A paper product according to claim 8, wherein the paper product has less than 0.25% oil pass-through according to crease testing.

10. A paper product according to claim 1, wherein the fluorochemical is present in an amount of less than about 2000 ppm.

11. A paper product according to claim 1, wherein the fluorochemical is provided as a result of size-press chemistry.

12. A paper product according to claim 1, wherein the web of fibers has a Canadian standard freeness value of about 150 $cm^3$ to about 350 $cm^3$.

13. A paper product according to claim 1, wherein the web of fibers has a Canadian standard freeness value of about 200 $cm^3$ to about 300 $cm^3$.

14. A paper product according to claim 1, wherein the viscosity modifier comprises sodium alginate and at least one selected from the group consisting of sodium carboxymethyl cellulose, hydroxylethyl cellulose, poly sodium acrylate, guar gum, gum arabic and xanthan gum.

* * * * *